US011348709B2

(12) United States Patent
Imai et al.

(10) Patent No.: US 11,348,709 B2
(45) Date of Patent: May 31, 2022

(54) NOISE-PREVENTING RESISTOR AND METHOD OF MANUFACTURING SAME

(71) Applicant: KOA CORPORATION, Ina (JP)

(72) Inventors: Tomohito Imai, Ina (JP); Kentaro Takashima, Ina (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 17/289,454

(22) PCT Filed: Oct. 23, 2019

(86) PCT No.: PCT/JP2019/041554
§ 371 (c)(1),
(2) Date: Apr. 28, 2021

(87) PCT Pub. No.: WO2020/095683
PCT Pub. Date: May 14, 2020

(65) Prior Publication Data

US 2021/0398717 A1 Dec. 23, 2021

(30) Foreign Application Priority Data

Nov. 5, 2018 (JP) ..... JP2018-208471

(51) Int. Cl.
*H01C 3/20* (2006.01)
*H01C 1/14* (2006.01)
*H01C 17/28* (2006.01)

(52) U.S. Cl.
CPC ..... *H01C 3/20* (2013.01); *H01C 1/14* (2013.01); *H01C 17/28* (2013.01)

(58) Field of Classification Search
CPC ..... H01C 3/20; H01C 1/14; H01C 17/28
See application file for complete search history.

(56) References Cited

U.S. PATENT DOCUMENTS 1,676,869 A * 7/1928 Richter ..... H01C 10/16 338/137
2,035,911 A * 3/1936 Mucher ..... H01C 3/20 338/209
2,985,951 A * 5/1961 Solow ..... H01C 3/16 29/618
3,311,968 A * 4/1967 Ardouin ..... H01C 1/148 29/619
3,319,210 A * 5/1967 Sandone, Jr. ..... H01C 1/148 338/322

(Continued)

FOREIGN PATENT DOCUMENTS

JP S43-2192 Y1 1/1968
JP 2016-111181 A 6/2016
JP 2016-134549 A 7/2016

*Primary Examiner* — Kyung S Lee
(74) *Attorney, Agent, or Firm* — Carrier Blackman & Associates, P.C.; William D. Blackman; Joseph P. Carrier

(57) ABSTRACT

A noise-preventing resistor has a structure in which a resistance wire is wound around an outer circumferential surface of a core, cap terminals are attached to either end part of the core, and part of an insulative coating (resin coating) covering the resistance wire and part of the resistance wire positioned underneath the insulative coating are cut, forming peeled regions exposing the resistance wire. As a result, conduction between the cap terminals and the resistance wire in the noise-preventing resistor is ensured.

14 Claims, 10 Drawing Sheets

(56) References Cited

U.S. PATENT DOCUMENTS

| | | | | |
|---|---|---|---|---|
| 9,548,156 | B2 * | 1/2017 | Kawai | H01F 38/12 |
| 10,256,014 | B2 * | 4/2019 | Imai | H01C 3/20 |
| 2019/0172614 | A1 * | 6/2019 | Mizouchi | H01C 17/28 |

* cited by examiner

NOISE-PREVENTING RESISTOR AND METHOD OF MANUFACTURING SAME

TECHNICAL FIELD

The present invention relates to a noise-preventing resistor mounted on an ignition plug of an internal-combustion engine, for example, and a manufacturing method thereof.

BACKGROUND ART

An engine ignition device of gasoline engine automobiles is ignited by applying a high-voltage current to an ignition plug (spark plug) so as to discharge, thereby spark igniting a compressed gas mixture of gasoline and air within a cylinder. Since a voltage of 10 kV or greater is required for ignition through discharge, the gasoline engine car is provided with an ignition coil for boosting the battery voltage.

The ignition coil is configured by a coil main body made up of a primary coil, a secondary coil, a core (iron core) around which these coils are wound, and an IC chip for controlling ignition etc. housed in an insulation case; a spring (connection terminal on the spark plug side) connected to a spark plug, a tubular insulation case housing the spring, etc. The coil main body is filled with resin and sealed.

Such engine ignition device has a noise-preventing resistor arranged within a tower part between the coil main body part and the spring, for example, and the coil main body part and the spark plug are electrically connected via the noise-preventing resistor, so as to control high frequency noise generating at the time of engine ignition.

On the other hand, slight warping of cap terminals of the noise-preventing resistor may occur due to fluctuation in dimensions at the time of formation and/or caulking when fitting the cap terminals to the resistive element made of an insulative core, a resistance wire, and an insulative coating. In that case, contact between a high voltage output terminal and the spring may be unstable, possibly leading to conduction failure as a result.

It is also important to secure sufficient conduction between the resistive element and the cap terminals of the noise-preventing resistor. Patent Document 1 discloses a noise-preventing resistor including a wire wound resistor constituted by an insulative core, conductor coils, paired metal caps, and a resin coating member, wherein protrusions which are facing the inner periphery of the side surfaces of the metal caps and perpendicular (along axial direction Z) to the winding direction of the conductor coils, are formed in the side part inner circumferential surfaces of the metal caps.

PRIOR ART DOCUMENTS

Patent Documents

Patent Document 1: JP 2016-134549A

DISCLOSURE OF THE INVENTION

Problems to be Solved by the Invention

The wire wound resistor disclosed in Patent Document 1 has the protrusions formed in the side part inner circumferential surfaces of the metal caps in order to secure electrical conduction between the metal caps and the conductor coils while preventing exposure of the conductor coils. In this wire wound resistor, when inserting the metal caps into the winding structure, the protrusions break the resin coating covering the conductor coils from the outer circumference side so that the metal caps make direct contact with the conductor coils.

With such a structured wire wound resistor, residue of the broken resin coating remains inside of and near the openings of the cap terminals, and may carbonize at the time of supplying power, leading to adverse effects on electrical performance of the resistor. Moreover, problems that the cap terminals end up opening due to repeated thermal expansion of the resin coating, causing a cap terminal to fall off and/or resin to get caught between a cap terminal and a conductor coil, and eventually leading to conduction failure, etc. are possible.

Furthermore, according to Patent Document 1, when the conductor coils are cut due to press-fitting of the protrusions, there is a possibility that ends of the conductor coils will stick out from the cap terminals, thereby causing a defect such as a short circuit due to the coils touching each other. There is also a problem that the cap terminals disclosed in Patent Document 1 are difficult to manufacture, leading to complicated manufacturing and processing.

In light of these problems, the present invention aims to provide a noise-preventing resistor preventing cap terminals from coming off, and securing conduction between the cap terminals and the resistance wire, and a manufacturing method thereof.

Means of Solving the Problems

The present invention aims to resolve the above problems, and includes the following structure, for example, as means for achieving the above aim. That is, the present invention is a noise-preventing resistor, including a resistive element, which comprises an insulative core, a resistance wire wound around an outer circumferential surface of the core, and an insulative coating, which covers an outer circumferential surface of the core and that of the resistance wire; and paired cap terminals attached to either end of the resistive element. It further includes peeled regions provided by removing the insulative coating in a plurality of places of the outer circumferential surface covered by the cap terminals, resulting in exposing the resistance wire.

For example, it is characterized in that the peeled regions are regions made by cutting part of the insulative coating and part of the resistance wire including the upper part positioned underneath the insulative coating. It is characterized in that, for example, the peeled regions have any one of a form extending linearly in the axial direction of the resistive element while having a predetermined width, form extending diagonally in the axial direction, form extending in a zig zag form in the axis direction, or form in an island-like shape. It is further characterized in that one end parts of the peeled regions reach an axial edge of the core, and the other end parts are positioned inside of the cap terminals. It is further characterized in that the peeled regions are arranged nearly equidistant without facing each other in the radial direction when viewing the resistive element from the axial direction. It is further characterized in that the peeled regions have a form extending along the circumference of the resistive element while having a predetermined width. It is yet further characterized in that the resistance wire and the cap terminals are electrically conductive within the peeled regions.

The present invention is a manufacturing method of a noise-preventing resistor having paired cap terminals attached to either end. The manufacturing method is characterized by including the steps of: binding fibrous insulating material so as to form a long core; winding a resistance wire around an outer circumferential surface of the core; applying an insulative coating to outer circumferential surfaces of the core and the resistance wire; cutting the core around which the resistance wire is wound to a predetermined length so as to form a resistive element; removing the insulative coating from a plurality of places in regions of the outer circumferential surface of the resistive element covered by the cap terminals so as to form peeled regions exposing the resistance wire; and attaching the cap terminals to either end of the resistive element in which the peeled regions are formed.

For example, it is characterized in that the peeled regions are made by cutting part of the insulative coating and part of the resistance wire including the upper part positioned underneath the insulative coating. It is characterized in that, for example, the cutting is carried out from a predetermined position separated axially from an end surface of the resistive element toward the other end surface side. It is further characterized in that, for example, the peeled regions are made in a plurality of places is carried out simultaneously.

Results of the Invention

According to the present invention, cap terminals that have been press-fit into a wire-wound resistive element are prevented from coming off, and the resistance wire and the cap terminals reliably make contact so as to ensure stable conduction therebetween.

DESCRIPTION OF EMBODIMENTS

Figure 1A:
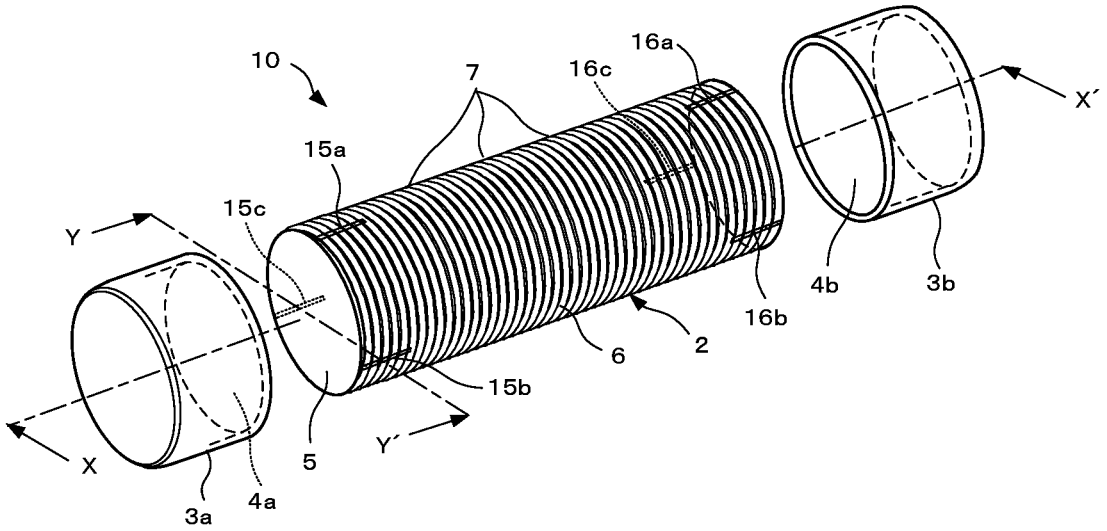
FIG. 1A shows an exploded perspective view of a noise-preventing resistor according to an embodiment of the present invention.
Figure 1B:
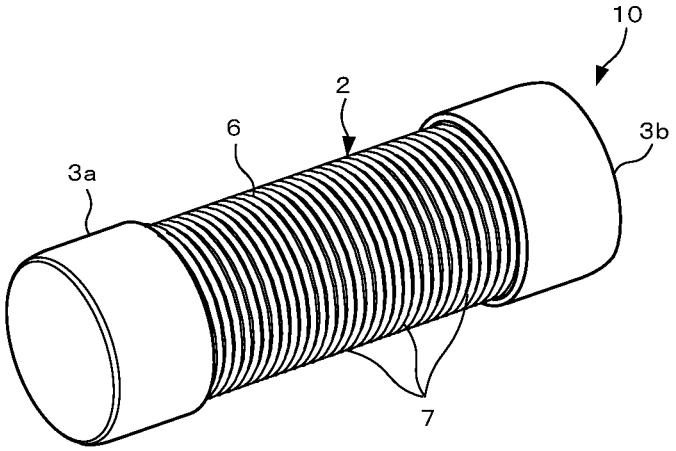
FIG. 1B shows an external perspective view of a noise-preventing resistor according to an embodiment of the present invention.
Figure 2A:
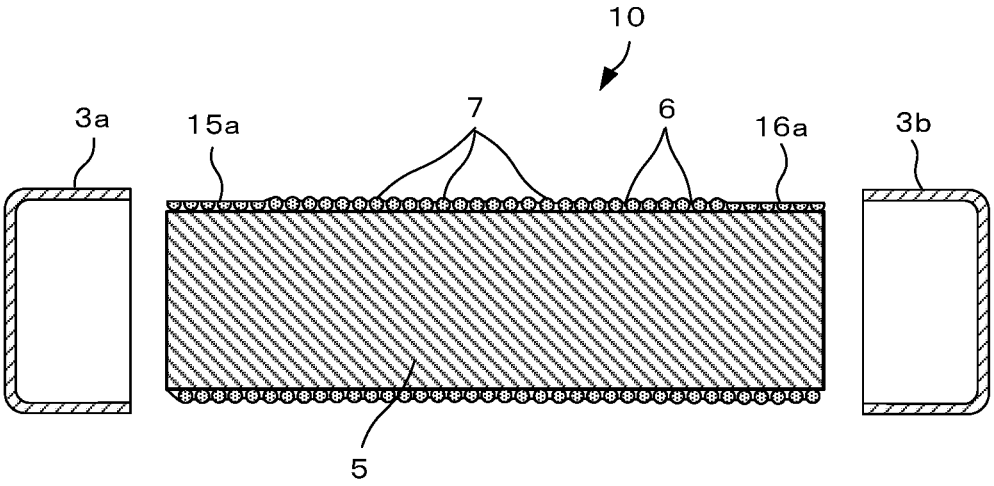
FIG. 2A shows a longitudinal cross-sectional view of the noise-preventing resistor according to the embodiment when cut along the axis thereof.
Figure 2B:
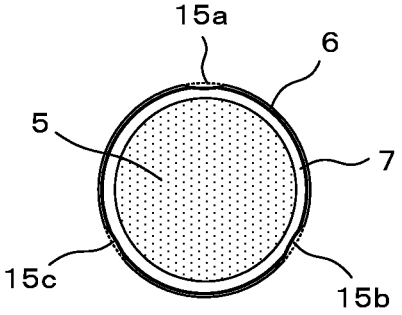
FIG. 2B shows a longitudinal cross-sectional view of the noise-preventing resistor according to the embodiment when cut perpendicular to the axis.

An embodiment according to the present invention is described in detail below with reference to accompanying drawings. FIG. 1A is an exploded perspective view of a noise-preventing resistor 10 (hereafter, also simply referred to as resistor) according to the embodiment, and FIG. 1B is an external perspective view of the noise-preventing resistor 10 according to the embodiment. In addition, FIG. 2A is a longitudinal cross-sectional view of the resistor when cut along the axial line indicated by arrows X-X' of FIG. 1A, and FIG. 2B is a longitudinal cross-sectional view of the same when cut perpendicular to the axis, that is, along a line indicated by arrows Y-Y' of FIG. 1A.

The noise-preventing resistor 10 illustrated in FIG. 1A etc. includes a wire-wound resistive element (also referred to as resistor) 2 having a resistance wire 7 wound around the outer circumferential surface of a rod-like (columnar) core 5 made of bound glass fibers, and cap terminals 3*a* and 3*b* attached to either end part of the wire-wound resistive element 2 and electrically connected to the resistance wire 7.

The resistor 10 is a noise-preventing resistor mounted on an engine ignition device, for example, and functioning as a noise filter for effectively controlling radiation noise such as ignition noise generating at the time of engine ignition.

The resistance wire 7 is selected from metal wires such as, for example, a nickel-iron (Ni—Fe) wire, a nickel (Ni) wire, a chromium (Cr) wire, and a nickel-chromium (Ni—Cr) wire in accordance with the resistance value of the resistor. Wire diameter of the resistance wire 7 is approximately several tens of μm (30 to 60 μm), for example, and the wire is continuously wound around the core 5 at a narrow pitch. The metal wire is used as is for the resistance wire 7. However, a coated conducting wire having a resin coating applied on the metal wire surface may be used.

Core material resulting from bundling many fibers made of insulating material such as glass, ferrite, resin or alumina, for example, is used as the core 5. A glass fiber bundle is appropriate from the viewpoint of cost and high heat resistance. The glass fiber bundle is made up of multiple glass fibers, each fiber having a diameter of several to several tens of μm. Therefore, due to the shape of the core not being maintained but curving when transported in a long state before cutting, epoxy resin, silicon resin, etc. for example, is impregnated into the glass fiber core so as to heat cure and maintain the shape thereof.

Other than glass, material for the core may be fibers made of insulating material such as ferrite, resin or alumina, for example, bundled together and shaped using resin.

An insulative coating (resin coating) 6 made of resin is formed on the outer circumferential surface of the wire-wound resistive element 2. Here, epoxy resin, silicon resin, etc. is applied coating the outer circumferential surface of the core 5 around which the resistance wire 7 is wound. The insulative coating 6 has a role of preventing the resistance wire from springing back.

As illustrated in FIGS. 1A, 2A and 2B, regions (peeled regions) 15*a* to 15*c* and 16*a* to 16*c* that expose the resistance wire are formed in portions of the outer circumferential surface end parts of the wire-wound resistive element 2 housed inside of the fitted cap terminals 3*a* and 3*b*, by cutting etc. part of the resin coating and part of the resistance wire including the upper part covered by the resin coating.

That is, regions in which the insulative coating 6 remains and regions (peeled regions) in which the insulative coating 6 is removed so as to expose the resistance wire 7 exist in either end part of the outer circumferential surface of the wire-wound resistive element 2, thereby allowing the exposed resistance wire 7 to make contact with the cap terminals 3*a* and 3*b*, and ending up securing electrical connections.

The cap terminals 3*a* and 3*b* are made of a conductive metal such as iron, stainless steel, etc., and the surfaces thereof are plated with copper or nickel etc. Moreover, the cap terminals 3*a* and 3*b* have openings 4*a* and 4*b*, respectively, for attaching (fitting) at either end of the wire-wound resistive element 2, and are formed in bottomed cylindrical shapes. Here, a long metal pipe is cut to a predetermined length, or a metal plate is cut to a predetermined length and bent, for manufacturing the cap terminals 3*a* and 3*b*.

Formation of the cap terminals 3*a* and 3*b* in a cylindrical form ensures, for example, connection stability with the ignition coil main body, and easiness of processing such as manufacturing by cutting a long metal pipe to a predetermined length or cutting a metal plate to a predetermined length and bent.

Note that since the resin coating as an insulative coating has a role of securing the resistance wire 7 as described above, thickness of the coating is set just thick enough to conceal the resistance wire 7. Meanwhile, if the thickness of the resin coating is uneven, the insulative coating is assumed to also be cut by the openings 4*a* and 4*b* of the cap terminals at the time of press-fitting the cap terminals 3*a* and 3*b*. However, due to having the peeled regions, an effect that the unevenness in thickness of the insulative coating is within an allowable range can be expected.

Figure 3:
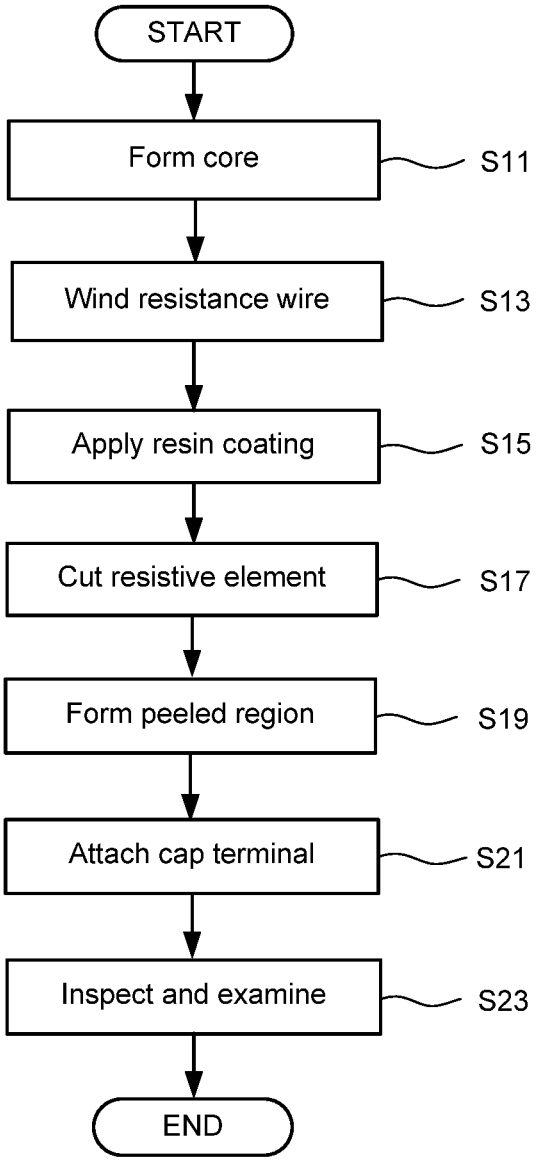
FIG. 3 is a flowchart showing manufacturing steps of the noise-preventing resistor according to the embodiment in time series.

Next, a manufacturing method of the noise-preventing resistor according to the embodiment is explained. FIG. 3 is a flowchart showing manufacturing steps of the noise-preventing resistor according to the embodiment in time series. First, a core for a resistor is formed in Step S11 of FIG. 3. Here, for example, glass fibers having a fiber diameter of several μm (several to several tens of μm) are bound, impregnated with either epoxy resin or silicon resin, and formed in a long bar shape so as to form a core. In Step S13, the resistance wire made of the material given above is continuously wound around the outer circumferential surface of the core at a predetermined pitch.

In Step S15, epoxy resin or silicon resin, for example, is coated on the outer circumferential surface of the core around which the resistance wire is wound as described above, dried and cured. Since the resin coating is for securing the resistance wire, thickness of the resin coating to be formed may be just thick enough to conceal the resistance wire, as described above. The applied resin coating is then cured.

In Step S17, a long resistive element that has the resistance wire wound around the outer circumferential surface and coated with resin is cut together with the resistance wire to a predetermined size using a cutter or the like. As a result, individual pieces of a wire-wound resistive element (resistor) are manufactured.

In Step S19, the peeled regions described above are formed. That is, part of the resin coating on the wire-wound resistive element surface is peeled off so as to expose the resistance wire. Here, the resin coating is peeled off using any one of the following methods.

(1) Cut the resin coating on the surface of the wire-wound resistive element and the upper part of the resistance wire using a cutter with a flat blade or round blade. At this time, cutting is performed from the axial inner side of the wire-wound resistive element outward (toward either end surface side). As a result, cut-off resin and residue of the resistance wire are not left on the surface of the wire-wound resistive element.

(2) Grind the resin coating on the surface of the wire-wound resistive element and the upper part of the resistance wire with a file.

(3) Scratch the resin coating on the surface of the wire-wound resistive element, and the upper part of the resistance wire using metal with a sharp point (may be a brush) so as to scrape them and expose the resistance wire.

In Step S21, a cap terminal is fit on either end of the wire-wound resistive element. For example, the cap terminals are mechanically pressed (press fitted) in the axial direction so as to fix them to the end parts of the wire-wound resistive element, with the openings of the cap terminals facing the axial end parts of the wire-wound resistive element. As a result, electric conduction between the resistance wire and the cap terminals may be ensured in the already-formed peeled regions.

In Step S23, examinations, such as appearance image inspection and resistance value measurement of the resistor manufactured in the steps described above, are performed. Note that the resin curing method of Step S15 described above may be any one of curing at room temperature, heat curing (at 100 to 200° C., for example), or curing through ultraviolet light radiation.

Figure 4:
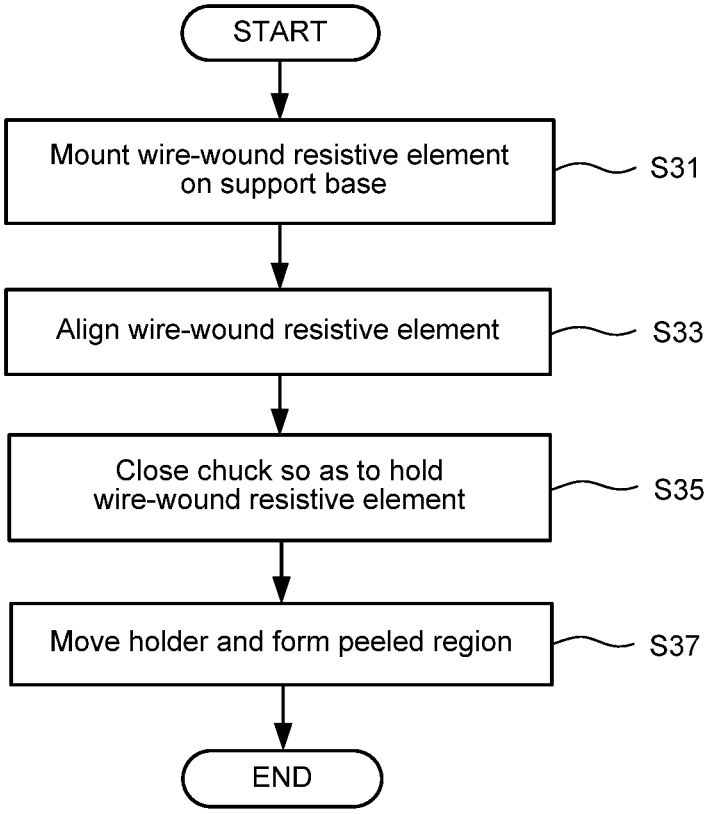
FIG. 4 is a flowchart giving details of the peeled region formation step of FIG. 3 in time series.

FIG. 4 is a flowchart giving details of the peeled region formation step (Step S19) of FIG. 3 in time series. Moreover, FIGS. 5A and 5B are a diagram schematically illustrating the entire structure of a machining device for forming etc. the peeled region in a wire-wound resistive element.

Figure 5A:
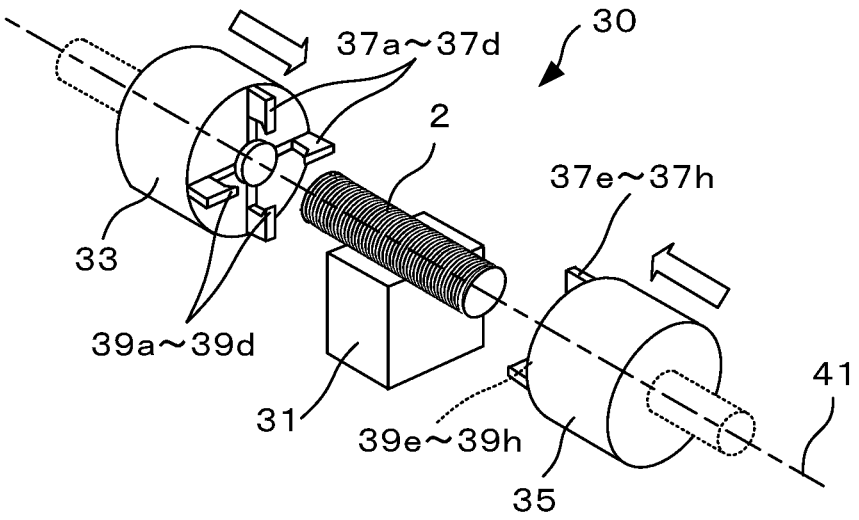
FIGS. 5A and 5B are diagrams schematically illustrating the entire structure of a machining device for forming etc. the peeled region.
Figure 5B:
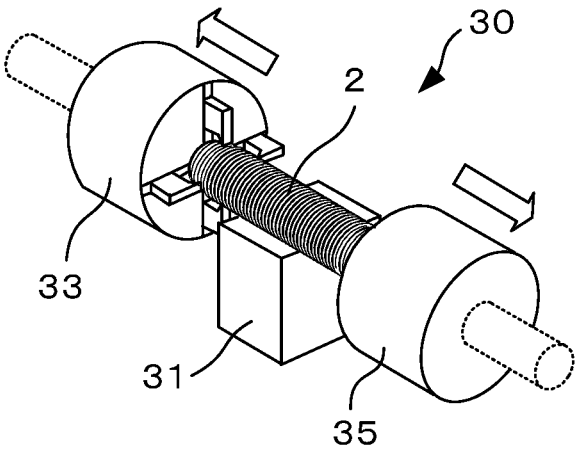

A machining device 30 illustrated in FIGS. 5A and 5B has a structure in which a holder (support) 33 including chucks 37*a* to 37*d* for clamping four rotatable cutters 39*a* to 39*d* as peeling means on tips, and a holder (support) 35 similarly including chucks 37*e* to 37*h* for clamping four rotatable cutters 39*e* to 39*h* as peeling means on tips are mounted facing each other along the same axis 41.

The cutters 39*a* to 39*d* and 39*e* to 39*h* are arranged radially along the outer circumference of the axis 41 on a plane perpendicular to the axis 41. The machining device 30 is structured such that only the cutters are replaceable when abrasion and/or damage occurs to these cutters.

In Step S31 of FIG. 4, the wire-wound resistive element 2 (also referred to as a work) is placed on a support base 31 of the machining device 30. The support base 31 has a part of the upper surface sunken in a semicircular form in accordance with the form of the wire-wound resistive element 2. Once the wire-wound resistive element 2 is placed on the support base 31, the wire-wound resistive element 2 is aligned in Step S33. This is for forming peeled regions of a predetermined length at predetermined positions in either end of the wire-wound resistive element 2 so as to expose the resistance wire.

In Step S35, the holder (support) 33 with the chucks 37*a* to 37*d* in an open state and the holder (support) 35 with the chucks 37*e* to 37*h* in an open state are moved in the directions indicated by arrows in FIG. 5A, stopping at predetermined positions from either end of the wire-wound resistive element 2. The chucks are then closed so as to clamp the wire-wound resistive element 2.

The predetermined positions where the wire-wound resistive element 2 is clamped from either end in this manner are starting points (ends) of the peeled regions for exposing the resistance wire. At the same time, the distance between electrodes is determined roughly by these predetermined positions.

Resistance value of the noise-preventing resistor according to the embodiment is determined according to positions (more specifically, mostly inward portions of the peeled regions in the axial direction) where the resistance wire conducts with the cap terminals. That is, while the conventional method of conducting and breaking the insulative coating has problems of varied conduction positions and unstable resistance values, resistance values of the resistor may be stabilized by determining the conduction positions ahead of time using non-coated regions (peeled regions) as in the embodiment.

In Step S37, the holders (supports) 33 and 35 are moved in directions indicated by arrows in FIG. 5B while the chucks are closed and clamping the wire-wound resistive element 2 as described above. As a result, multiple peeled regions are formed simultaneously in the wire-wound resistive element 2.

Note that while the machining device 30 illustrated in FIGS. 5A and 5B has four chucks in accordance with the number of peeled regions to be formed, in the case of forming peeled regions in four or more places with the machining device 30 having two chucks, it is possible to either rotate the wire-wound resistive element 2 or rotate the holders 33 and 35, and repeat Steps S35 and S37 described above.

Moreover, the peeled regions are preferably formed equidistant in multiple places on the circumferential surface of the wire-wound resistive element 2, and formed at positions such that they are not facing each other when viewed from the axial direction.

Figure 6A:
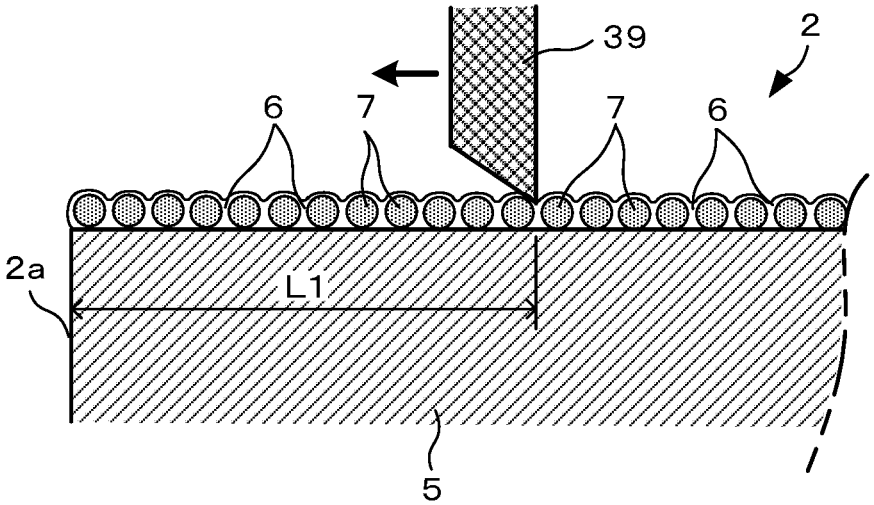
FIGS. 6A and 6B show cross-sectional views illustrating a detailed structure of the peeled region formed in an end part of a wire-wound resistive element.
Figure 6B:
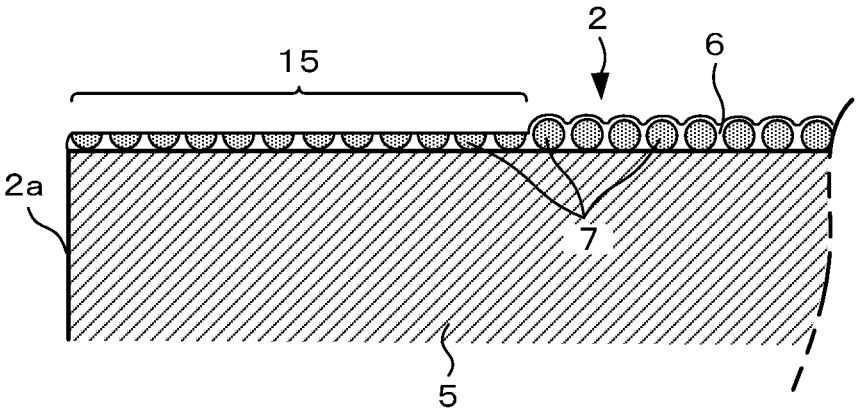
Figure 7:
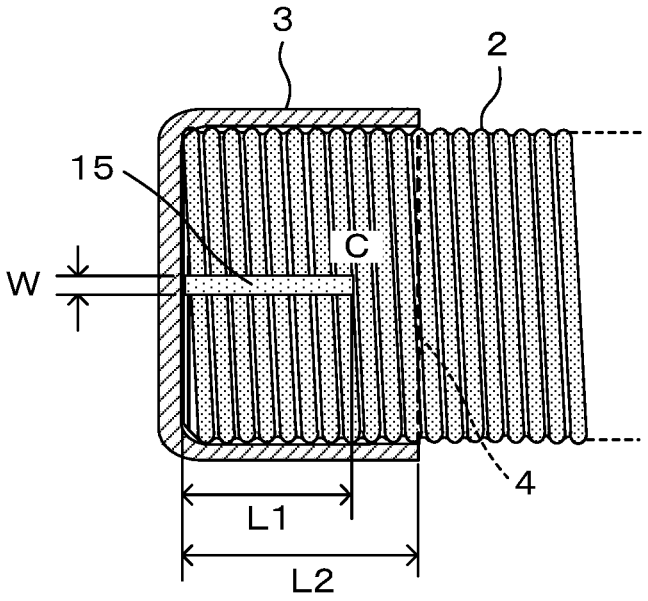
FIG. 7 is an enlarged view of the peeled region formed in the end part surface of the wire-wound resistive element.

FIGS. 6A and 6B show cross-sectional views illustrating a detailed structure of a peeled region formed in an end part of the wire-wound resistive element. In addition, FIG. 7 is an enlarged view of the peeled region formed in the end part surface of the wire-wound resistive element.

FIG. 6A illustrates the wire-wound resistive element 2 placed on the support base 31 of the machining device 30 of FIGS. 5A and 5B, and positioning the cutter 39 at a distance L1 in the axial direction from an end surface 2*a*. This corresponds to Step S33 of FIG. 4.

FIG. 6B illustrates a formed peeled region 15, which results from moving the cutter 39 in the direction of the arrow of FIG. 6A, thereby cutting part of the resistance wire 7 and part of the insulative coating 6 on the end part surface of the wire-wound resistive element 2 from the axial direction inner side of the wire-wound resistive element 2 toward the end part side. This corresponds to Step S37 of FIG. 4, where the peeled region 15 is formed linearly in the axial direction of the wire-wound resistive element 2 as illustrated in FIG. 7.

In this manner, cutting part of the insulative coating and part of the resistance wire including the upper part so as to make them flat reliably makes the cap terminals and the resistance wire in that region have surface contact, thereby securing mutual electrical conduction. Moreover, as described later, the cutter is positioned such that the upper part of the resistance wire is cut, thereby allowing formation of a peeled region by reliably cutting the insulative coating, even if there is fluctuation in thickness of the insulative coating and core diameter.

The peeled region 15 is formed linearly outward from the axial direction inner side of the wire-wound resistive element 2 as illustrated in FIG. 7. Axial length (cut length) L1 of the peeled region 15 does not exceed depth L2 of the tubular inner part of the cap terminal 3. That is, the peeled region 15 is formed at a position that is not exposed from the opening 4 of the cap terminal 3 of the noise-preventing resistor 10 according to the embodiment.

It is assumed that even if the position of an end part C of the peeled region 15 is near the opening 4 of the cap terminal 3, are discharge etc. generates between the resistance wire and the cap terminal. Therefore, distance between the end part C of the peeled region 15 and the opening 4 of the cap terminal 3, namely difference distance: L2−L1, where L2 denotes depth of the cap terminal and L1 denotes cut length as shown in FIG. 7, may be determined based on the voltage applied to the cap terminal and the number of turns of the resistance wire wound in the difference distance.

Figure 8A:
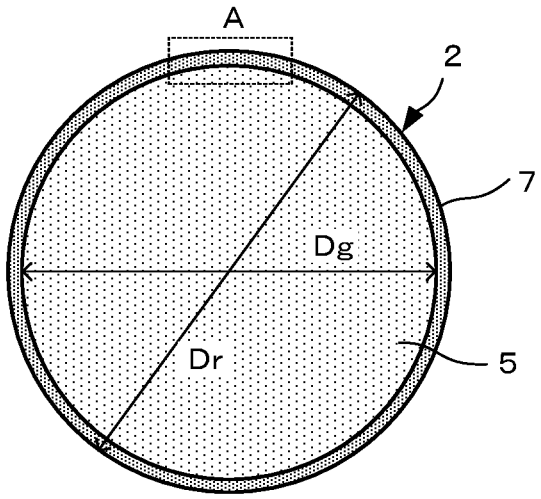
FIGS. 8A and 8B show diagrams illustrating an exemplary relationship between cutting depth of the peeled region and cutter blade width.
Figure 8B:
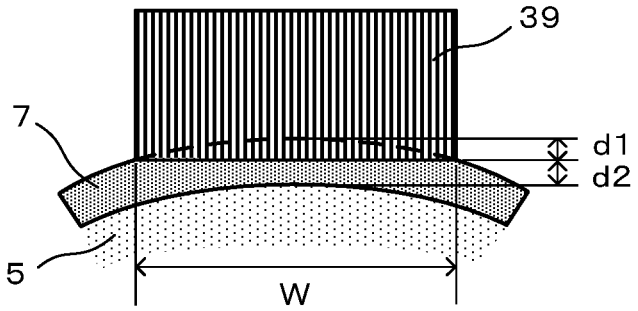

FIGS. 8A and 8B show diagrams illustrating an exemplary relationship between cutting depth of the peeled region and cutter blade width. FIG. 8A is a cross-section of the wire-wound resistive element 2 when cut perpendicular to the axial direction, where Dg denotes the diameter of the core 5, and Dr denotes diameter including the resistor made from the resistance wire 7 winding around the circumferential surface of the core 5.

FIG. 8B shows the depth of the upper part of the resistance wire 7 cut together with the resin coating, and the blade width of the cutter 39 used for cutting when forming the peeled region in region A of FIG. 8A.

It is confirmed that even if up to approximately 50% of the resistance wire including the upper part is cut radially within the peeled region of the noise-preventing resistor according to the embodiment, resistance property is not influenced. As a result, the case of cutting 50% of the resistance wire 7 using the cutter 39 is considered. If wire diameter ((Dr−Dg)/2) of the resistance wire 7 of FIG. 8A is, for example, 30 μm where Dr is 3.82 mm and Dg is 3.76 mm, cutting the resistance wire 7 until a depth d1 of 0.015 mm using the cutter 39 is possible while depth d2 of 0.015 mm remains. Accordingly, blade width W of the cutter 39 necessary for this case is 0.48 mm. This is also cut width W along the circumference of the peeled region 15 in FIG. 7.

Note that while a round blade fitted with a curve of the resistor diameter Dr that changes according to the wire diameter of the resistance wire 7 may be used as the cutter 39, a flat blade unaffected by the wire diameter may be used from the viewpoint of cost.

As described above, the noise-preventing resistor according to the embodiment has a structure including: a cap terminal, which is attached to either end part of a wire-wound resistive element made by winding a resistance wire around the outer circumferential surface of a core, and peeled regions, which are provided by cutting a part of an insulative coating (resin coating) covering the resistance wire and a part of the resistance wire underneath the coating, so as to expose the resistance wire.

Since such peeled regions are provided, the cap terminals may be smoothly press-fit in the wire-wound resistive element, preventing the cap terminals from coming off without deformation even after fitting. Moreover, the core is not damaged when press-fitting the cap terminals, nor is strength against compression load applied axially on the wire-wound resistive element lost. As a result, the resistance wire and the cap terminals will make contact reliably in the peeled regions, ensuring stable electric conduction between the resistance wire and the cap terminals.

Furthermore, since the regions that are covered by the cap terminals on the outer circumferential surface of the wire-wound resistive element are used as peeled regions, contact portions of the cap terminals with the resistance wire will be identified uniquely and easily, making it possible to stabilize the resistance value of the noise-preventing resistor.

Yet further, the peeled regions formed through cutting until reaching either edge of the wire-wound resistive element will prevent the resin coating from being pushed into the openings of the cap terminals when press-fitting the cap terminals, and will also stabilize electrical conduction between the resistance wire and the cap terminals even if the slightest difference in level generates between insulative coated regions and non-coated regions, that is, the peeled regions.

In addition, since the peeled regions have a specific form and size that fit inside the attached cap terminals, the exposed resistance wire in the peeled regions exists inside of the cap terminals, thereby preventing exposure at the openings, resulting in preventing deterioration of the noise-preventing resistor due to rust etc. during use.

Modified Examples

Figure 9A:
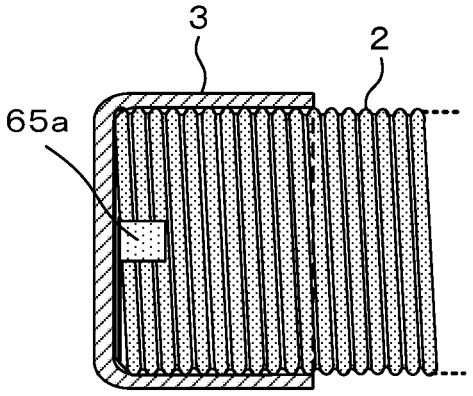
FIGS. 9A to 9E show diagrams explaining modified examples of the peeled region.
Figure 9B:
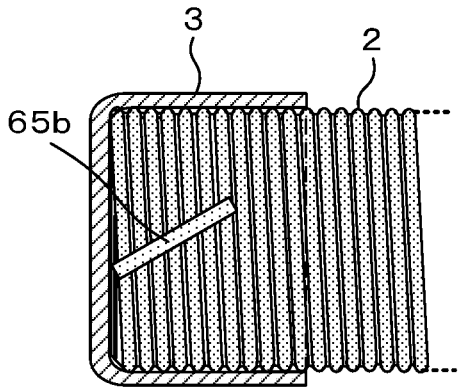

The present invention is not limited to the embodiment described above, and various modifications are possible. According to the embodiment described above, the peeled regions are provided extending linearly in the axial direction of the wire-wound resistive element. However, they are not limited thereto. For example, FIG. 9A illustrates a peeled region 65*a* formed in an island-like shape in an end part surface of the wire-wound resistive element 2, and FIG. 9B illustrates a peeled region 65*b* having a form extending linearly and diagonally in the axial direction of the wire-wound resistive element 2 while having a predetermined width.

Figure 9C:
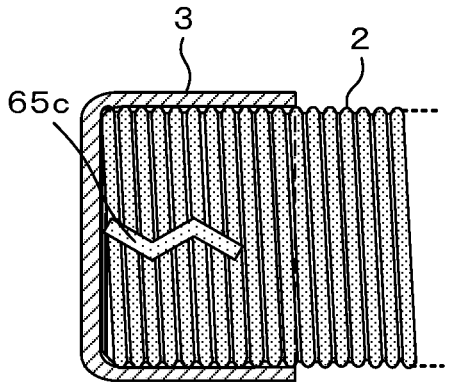
Figure 9D:
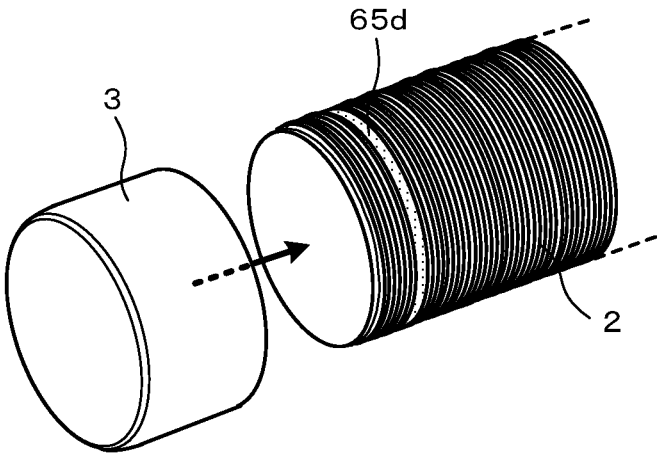

FIG. 9C illustrates a peeled region 65*c* having a form extending in a zig zag form in the axial direction of the wire-wound resistive element 2, and FIG. 9D illustrates a peeled region 65*d* having a form extending along the circumference in the end part surface of the wire-wound resistive element 2. Since the peeled regions illustrated in FIGS. 9C and 9D have comparatively larger cut insulative coating areas, further stable conduction between the resistance wire and the cap terminals may be ensured.

Figure 9E:
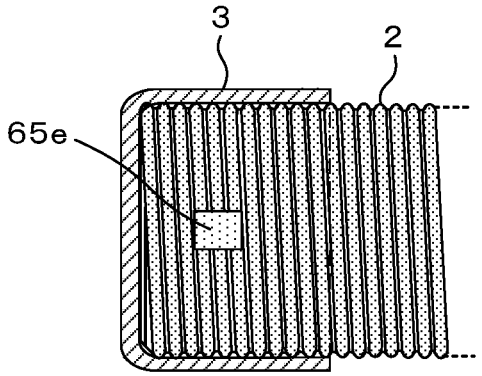

FIG. 9E is an example where a peeled region 65*e* formed in an island-like shape is formed positioned inside of the cap terminal 3 on the axial inner surface of the wire-wound resistive element 2.

Note that the peeled region 65*d* may have a form circling the end part surface of the wire-wound resistive element 2, or may have an orbiting form with intermittent breaks. Alternatively, while it is omitted from the drawings, the peeled region may have a form extending in a spiral form along the circumference of the wire-wound resistive element.

DESCRIPTION OF REFERENCE NUMBERS AND CHARACTERS

2: Wire wound, resistive element (resistor)
3, 3*a*, 3*b*: Cap terminal
4, 4*a*, 4*b*: Opening
5: Core
6: Insulative coating (resin coating)
7: Resistance wire
10: Noise-preventing resistor
15, 15*a*-15*c*, 16*a*-16*c*, 65*a*-65*e*: Peeled region
30: Machining device
31: Support base
33, 35: Holder (support)
37*a*-37*h*: Chuck
39, 39*a*-39*h*: Cutter
41: Axis

The invention claimed is:

1. A noise-preventing resistor, including a resistive element, which comprises an insulative core, a resistance wire wound around an outer circumferential surface of the core, and an insulative coating which covers an outer circumferential surface of the core and that of the resistance wire, and paired cap terminals attached to ends of the resistive element;

wherein the resistive element has peeled regions provided by removing the insulative coating in a plurality of places of the outer circumferential surface of the resistance wire configured to be covered by the cap terminals before the cap terminals are installed thereon, resulting in exposing the resistance wire, the peeled regions made by cutting part of the insulative coating and part of the resistance wire, including an outer part thereof positioned underneath the insulative coating, and arranged so as to make the exposed resistance wire and the cap terminals have surface contact with each other without caulking where the cap terminals are press fitted and attached to the resistive element.

2. The noise-preventing resistor according to claim 1, wherein the peeled regions have any one of:

a form extending linearly in an axial direction of the resistive element while having a predetermined width, a form extending diagonally in the axial direction, a form extending in a zig zag form in the axis direction, or a form in an island-like shape.

3. The noise-preventing resistor according to claim 2, wherein one of two end parts of each of the peeled regions reaches an axial edge of the core, and the other of the end parts is positioned inside of one of the cap terminals.

4. The noise-preventing resistor according to claim 2, wherein the peeled regions are arranged substantially equidistant without facing each other in the radial direction when viewing the resistive element from the axial direction.

5. The noise-preventing resistor according to claim 4, wherein the resistance wire and the cap terminals are electrically conductive within the peeled regions.

6. The noise-preventing resistor according to claim 1, wherein the peeled regions have a form extending along the circumference of the resistive element while having a predetermined width.

7. The noise-preventing resistor according to claim 1, wherein portions of the peeled regions are made flat.

8. A manufacturing method of a noise-preventing resistor having paired cap terminals attached to ends of the noise-preventing resistor, said method comprising the steps of:

binding fibrous insulating material so as to form a long core;

winding a resistance wire around an outer circumferential surface of the core;

applying an insulative coating to outer circumferential surfaces of the core and the resistance wire;

cutting the core around which the resistance wire is wound to a predetermined length so as to form a resistive element;

cutting part of the insulative coating and part of the resistance wire including an outer part thereof positioned underneath the insulative coating, and removing the insulative coating from a plurality of places in regions of the outer circumferential surface of the resistive element configured to be covered by the cap terminals so as to form peeled regions exposing the resistance wire; and press-fitting and attaching the cap terminals without caulking to either ends of the resistive element in which the peeled regions are formed, wherein the peeled regions are made so as to allow the exposed resistance wire to make surface contact with the cap terminals, and are arranged substantially equidistant without facing each other in the radial direction when viewing the resistive element from the axial direction.

9. The manufacturing method of a noise-preventing resistor according to claim 8, wherein the cutting is carried out from a predetermined position separated axially from an end surface of the resistive element toward the other end surface side.

10. The manufacturing method of a noise-preventing resistor according to claim 8, wherein the peeled regions are made in the plurality of places simultaneously.

11. The manufacturing method of a noise-preventing resistor according to claim 8, wherein the resistance wire and the cap terminals are electrically conductive within the peeled regions.

12. The manufacturing method of a noise-preventing resistor according to claim 8, wherein portions of the peeled regions are made flat.

13. A noise-preventing resistor including a resistive element, which comprises an insulative core, a resistance wire wound around an outer circumferential surface of the core, and an insulative coating which covers an outer circumferential surface of the core and that of the resistance wire, and paired cap terminals attached to ends of the resistive element; wherein peeled regions are provided in limited areas of the resistor by removing the insulative coating and removing an outer part of the resistance wire in a plurality of places of the outer circumferential surface configured to be covered by the cap terminals before the cap terminals are installed thereon, resulting in exposing the resistance wire in said limited areas.

14. The noise-preventing resistor according to claim 13, wherein peeled regions are arranged substantially equidistant without facing each other in the radial direction when viewing the resistive element from the axial direction.

* * * * *